US009741323B2

(12) United States Patent
Gold

(10) Patent No.: US 9,741,323 B2
(45) Date of Patent: Aug. 22, 2017

(54) INSERTABLE PERCUSSION SYSTEM

(71) Applicant: Steven Gold, Tiburon, CA (US)

(72) Inventor: Steven Gold, Tiburon, CA (US)

( * ) Notice: Subject to any disclaimer, the term of this patent is extended or adjusted under 35 U.S.C. 154(b) by 0 days.

(21) Appl. No.: 14/658,388

(22) Filed: Mar. 16, 2015

(65) Prior Publication Data

US 2016/0275923 A1 Sep. 22, 2016

(51) Int. Cl.
*G10D 13/00* (2006.01)
*G10D 13/02* (2006.01)
*G10D 13/06* (2006.01)

(52) U.S. Cl.
CPC ..... *G10D 13/006* (2013.01); *G10D 13/026* (2013.01); *G10D 13/029* (2013.01); *G10D 13/065* (2013.01)

(58) Field of Classification Search
CPC .. G10D 13/006; G10D 13/026; G10D 13/029; G10D 13/065
USPC ..... 84/422.1, 422.3, 421, 411 P, 411 R
See application file for complete search history.

(56) References Cited

U.S. PATENT DOCUMENTS 3,215,021 A * 11/1965 Kester, Jr. ..... G10D 13/021 84/411 M
3,433,115 A * 3/1969 Kjelstrom ..... G10D 13/00 84/411 M
3,464,305 A * 9/1969 Meazzi ..... G10D 13/065 84/422.3
3,742,810 A * 7/1973 Crigger ..... G10D 13/065 84/422.3
3,747,464 A * 7/1973 Russell ..... G10D 13/006 84/422.1
3,893,363 A * 7/1975 Cohen ..... G10G 5/00 248/124.1
4,111,095 A * 9/1978 Simons ..... G10G 5/00 248/125.1
4,337,684 A * 7/1982 Le Mert ..... G10D 13/00 84/421
4,449,440 A * 5/1984 Hoshino ..... G10D 13/065 84/422.3
4,453,446 A * 6/1984 Hoshino ..... G10D 13/026 84/421
4,491,050 A * 1/1985 Franzmann ..... G10C 3/14 84/746
4,987,817 A * 1/1991 Diaz ..... G10D 13/06 84/421
5,063,821 A * 11/1991 Battle ..... G10H 1/32 84/411 R
5,192,822 A * 3/1993 Hoshino ..... G10D 13/065 84/421
5,267,500 A * 12/1993 Lombardi ..... G10D 13/065 84/402
5,789,688 A * 8/1998 Schiano ..... G10D 13/065 84/422.1
5,803,642 A * 9/1998 Sassmannshausen F16C 11/0604 248/124.1

(Continued)

*Primary Examiner* — David Warren
*Assistant Examiner* — Christina Schreiber
(74) *Attorney, Agent, or Firm* — Renner Otto Boisselle & Sklar, LLP

(57) ABSTRACT

A percussion system comprising a pedal and an inserting/retracting mechanism operably connected to a percussion instrument and the pedal from moving the percussion instrument horizontally from a first position to a second position and from the second position to the first position by operation of the pedal.

19 Claims, 12 Drawing Sheets

(56) References Cited

U.S. PATENT DOCUMENTS 5,990,401 A * 11/1999 Braun ..... G10D 13/006 84/104
6,307,136 B1 * 10/2001 Sikra ..... G10D 13/006 84/422.1
6,528,714 B1 * 3/2003 Liao ..... G10D 13/065 84/422.1
6,822,150 B1 * 11/2004 Lombardi ..... G10D 13/065 84/422.1
6,825,407 B1 * 11/2004 Curren ..... G10D 13/06 84/402
7,074,997 B2 * 7/2006 Steele ..... G10D 13/006 84/422.1
7,094,959 B2 * 8/2006 Marnell ..... G10D 13/065 84/422.1
7,232,947 B1 * 6/2007 Lombardi ..... G10D 13/065 84/327
7,339,103 B2 * 3/2008 Hilburn ..... G10D 13/006 200/86.5
7,342,163 B2 * 3/2008 O'Donnell ..... G10D 13/065 84/422.3
7,348,480 B1 * 3/2008 Liao ..... G10D 13/065 84/422.1
7,351,902 B1 * 4/2008 Sikra ..... G10D 13/065 84/422.1
7,468,480 B1 * 12/2008 Sikra ..... G10D 13/026 84/421
7,528,312 B1 * 5/2009 DiGiovanni ..... G10D 13/02 84/411 R
7,655,854 B1 * 2/2010 Wang ..... G10D 13/065 84/421
7,804,015 B1 * 9/2010 Wilson ..... G10D 13/06 84/422.1
8,178,769 B2 * 5/2012 Steele ..... G10D 13/006 84/421
8,292,250 B2 * 10/2012 Jines ..... A47B 19/002 108/176
8,754,314 B1 * 6/2014 Bachman, III ..... G10D 13/065 84/422.1
8,927,842 B1 * 1/2015 Honjo ..... G10D 13/026 84/411 R
8,940,989 B1 * 1/2015 Spriggel ..... G10D 13/065 84/422.3
9,093,053 B2 * 7/2015 Jungeberg ..... G10G 7/00
9,208,761 B2 * 12/2015 Miyajima ..... G10D 13/06
9,214,142 B2 * 12/2015 May ..... G10G 5/005
2004/0025664 A1 * 2/2004 Bennett ..... G10D 13/029 84/411 P
2005/0121565 A1 * 6/2005 Johnson ..... F16M 11/18 248/125.1
2005/0150355 A1 * 7/2005 Sutej ..... G10D 13/065 84/422.3
2005/0172784 A1 * 8/2005 Lee ..... G10D 13/065 84/422.1
2005/0211058 A1 * 9/2005 Crane ..... G10D 13/06 84/402
2005/0284283 A1 * 12/2005 May ..... G10D 13/029 84/411 P
2006/0207408 A1 * 9/2006 Steele ..... G10D 13/006 84/422.1
2008/0072737 A1 * 3/2008 Steele ..... G10D 13/006 84/422.1
2008/0229902 A1 * 9/2008 Mori ..... G10G 5/00 84/421
2009/0229444 A1 * 9/2009 Measelle ..... G10D 13/026 84/421
2012/0006178 A1 * 1/2012 Steele ..... G10D 13/006 84/421
2014/0116229 A1 * 5/2014 Mori ..... G10D 13/02 84/415
2016/0005386 A1 * 1/2016 Mori ..... G10D 13/026 84/421
2016/0275923 A1 * 9/2016 Gold ..... G10D 13/006

* cited by examiner

INSERTABLE PERCUSSION SYSTEM

FIELD OF THE INVENTION

The present invention relates to percussion instruments, and particularly to a system for inserting and retracting percussion instruments.

DESCRIPTION OF THE RELATED ART

Percussion sets have been developed that produce a large variety of different sounds. Percussion sets may include, for example, drums, cymbals, bells, cowbells, hi-hats, tambourines, wood blocks, etc. Even among drums a large variety of different drums exists such as, for example, kettle drums, steel drums, bongo drums, tom-toms, bass drums, tenor drums, snare drums, etc. To add to the abundance of sounds produced by these different percussion instruments, different techniques (e.g., rim shots, etc.) for striking or beating these percussion instruments have been developed to obtain different sounds from any one instrument.

Conventionally, however, percussion instruments were located relative to the player (i.e., the percussionist) at fixed positions. Since the instruments take space, there was a limit in the amount of instruments that may form part of any one percussion set. Moreover, the fixed locations of each of the instruments limited the number of sounds that the percussion set could produce.

BRIEF SUMMARY OF THE INVENTION

The invention disclosed herein provides a system for inserting and retracting percussion instruments from a percussion set. Using the systems disclosed herein players are able to produce broader ranges of sounds and rhythms because different arrangements of percussion instruments may be available to the percussionist as the percussionist is playing that otherwise would not be available.

Moreover, an arrangement may be set where, for example, drum beats occur from striking a first drum downwardly and a second drum, that has been inserted above the first drum by use of the systems disclosed herein, upwardly. This way, the percussionist may double the amount of resulting drum beats; i.e., the conventional beats from the downward strikes plus the beats that result from the upward strikes.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
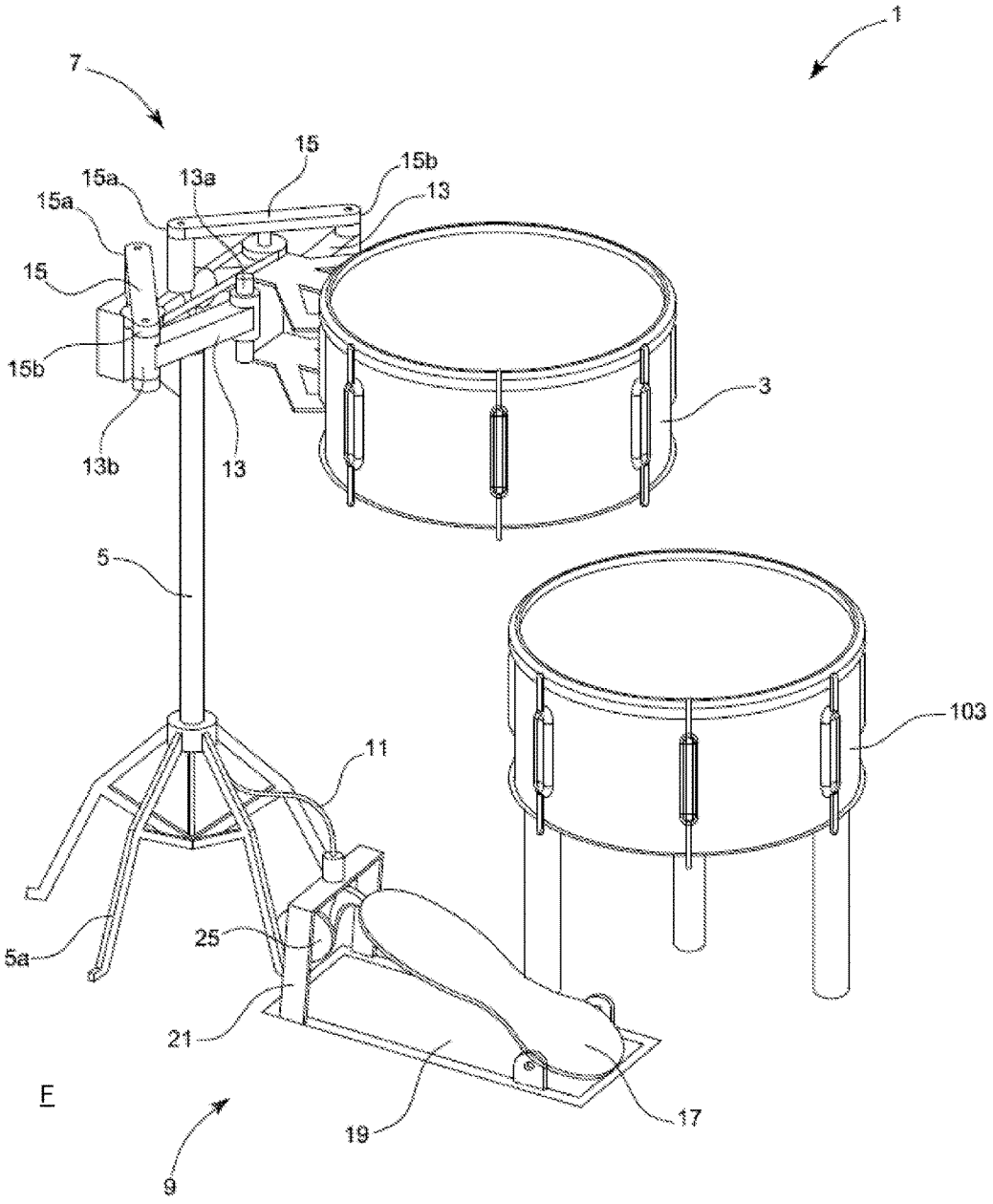
FIG. 1 illustrates a perspective view of an exemplary insertable percussion system in the retracted position.
Figure 2A:
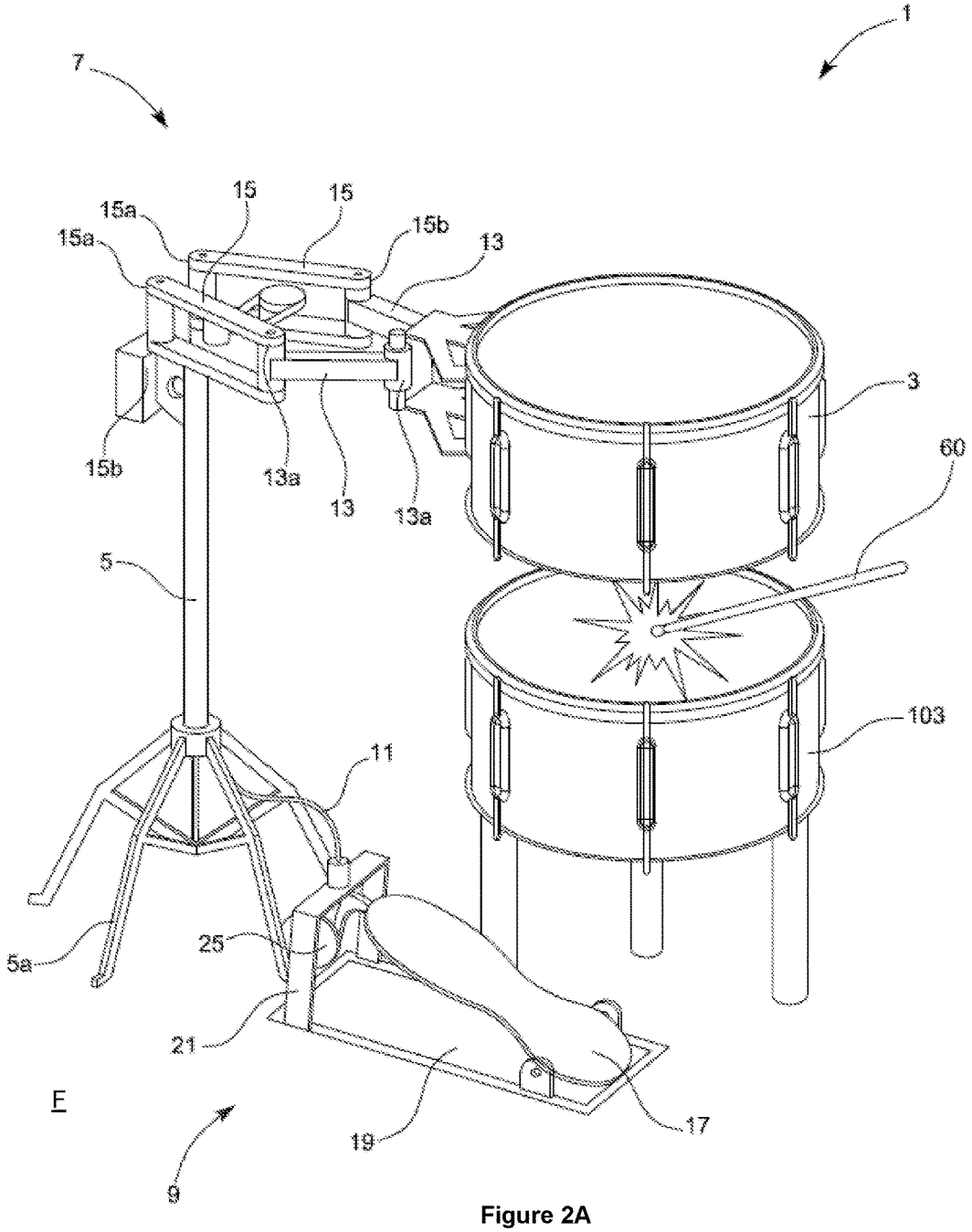
FIG. 2A illustrates a top perspective view of the exemplary insertable percussion system of FIG. 1 in the inserted position.
Figure 2B:
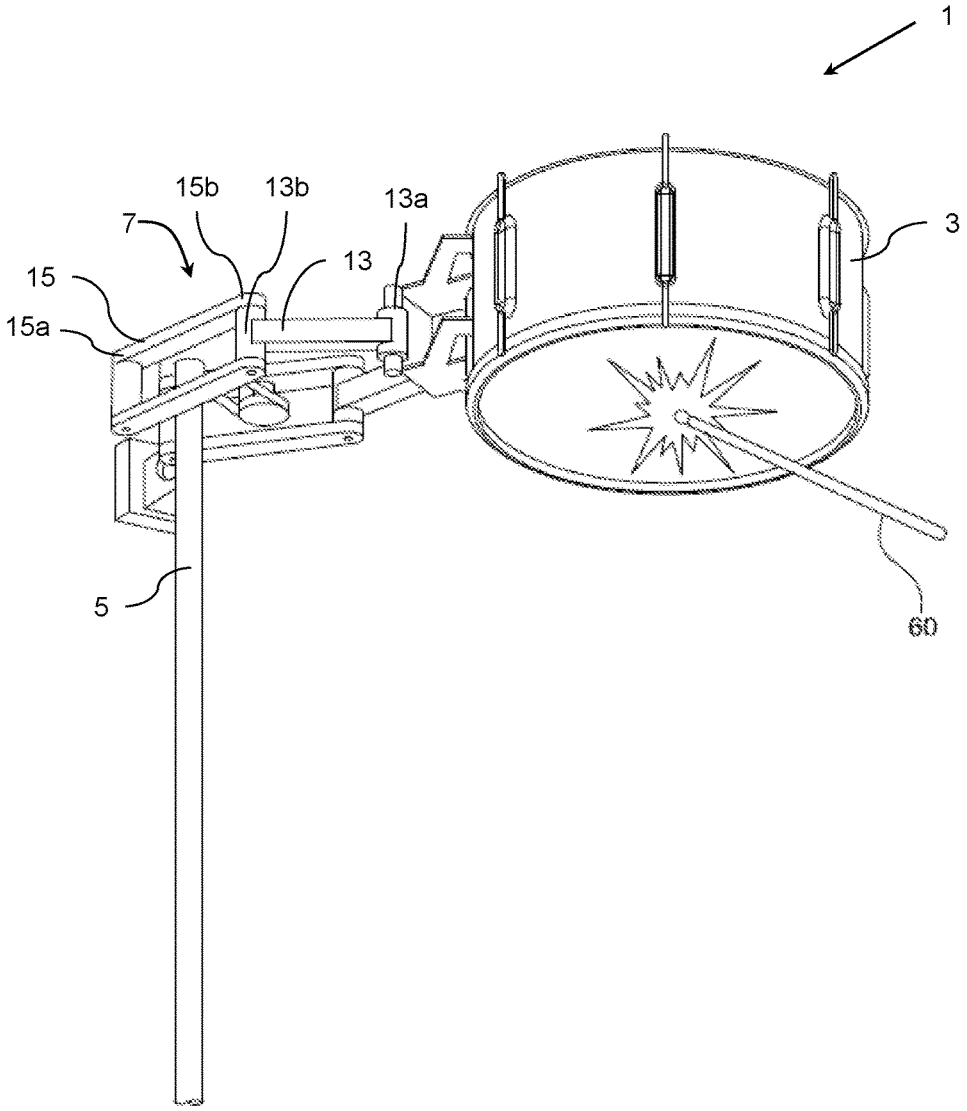
FIG. 2B illustrates a bottom perspective view of the exemplary insertable percussion system of FIG. 1 in the inserted position.

FIGS. 1, 2A and 2B illustrate perspective views of an exemplary insertable percussion system 1. The system 1 includes a percussion instrument 3. In the illustrated embodiment, the percussion instrument 3 corresponds to a drum. In other embodiments, the percussion instrument 3 may correspond to percussion instruments different from a drum. The insertable percussion system 1 also includes a stand 5 that has a base or feet 5*a* for sustaining the stand 5 off a floor F. The stand 5 generally sustains the percussion instrument 3 vertically off the floor F.

The insertable percussion system 1 also includes an inserting/retracting mechanism 7 connected to the percussion instrument 3 and the stand 5. The system 1 also includes a pedal 9 disposed on the floor F at or near the base 5*a* of the stand 5. The stand 5 vertically separates the percussion instrument 3 and the inserting/retracting mechanism 7 from the pedal 9. The insertable percussion system 1 also includes a cable 11 that connects the pedal 9 to the inserting/retracting mechanism 7. Operation (i.e., pressing and releasing) of the pedal 9 up or down causes the pedal 9 to pull and release on the cable 11 which, in turn, causes the inserting/retracting mechanism 7 to move the percussion instrument 3 substantially horizontally.

Pressing down on the pedal 9 causes the pedal 9 to pull on the cable 11 which, in turn, causes the inserting/retracting mechanism 7 to move the percussion instrument 3 substantially horizontally from a retracted position as shown in FIG. 1 to an inserted position as shown in FIGS. 2A and 2B. Releasing up on the pedal 9 causes the pedal 9 to release on the cable 11 which, in turn, causes the inserting/retracting mechanism 7 to move the percussion instrument 3 substantially horizontally from the inserted position shown in FIGS. 2A and 2B back to the retracted position of FIG. 1.

In one embodiment, the insertable percussion system 1 as shown in FIGS. 1, 2A and 2B forms part of a drum or percussion set. In the percussion set, the percussion instrument 3 may be inserted by operation of the pedal 9 as described above to make the percussion instrument 3 temporarily available to the percussionist to play. The percussion instrument 3, for example, may be inserted above another instrument 103 in the percussion set to make the percussion instrument 3 available to the percussionist for playing instead of the other instrument 103. Whenever the percussionist is ready to return to playing the other instrument 103, the percussionist may remove or retract the percussion instrument 3 by operation of the pedal 9 to make the other instrument available for the percussionist to play.

In one embodiment, the insertable percussion system 1 as shown in FIGS. 1, 2A and 2B forms part of a drum or percussion set including another percussion instrument 103 intended to be played by being hit with a downstroke or downward motion of a beater or a drum stick 60, as shown in FIG. 2A. In this embodiment, the percussion instrument 3 may be intended to be played by being hit with an upstroke or upward motion of the beater or the drum stick 60, as shown in FIG. 2B. In this setting, the percussion instrument 3 may be inserted above the downstroke percussion instrument 103 to make the percussion instrument 3 available to the percussionist for playing in the upstroke in combination with the downstroke percussion instrument 103. By operation of the pedal 9, the percussion instrument 3 may be moved horizontally into the inserted position above the downstroke percussion instrument 103.

In another embodiment, the roles are reversed; i.e., the percussion instrument 3 may be intended to be played by being hit with a downstroke or downward motion of the beater or the drum stick and the percussion instrument 3 is inserted under or below an upstroke percussion instrument.

The percussionist may strike the downstroke percussion instrument 103 in the downstroke motion and the upstroke percussion instrument in the proceeding (i.e., immediately after) upstroke motion. This way, the percussionist may double the amount of resulting drum beats; i.e., the conventional beats from the downward strikes plus the beats that result from the upward strikes of the percussion instrument 3. Whenever the percussionist is ready to conclude playing in this upstroke/downstroke mode, the percussionist may remove or retract the percussion instrument 3 by operation of the pedal 9.

In the upstroke/downstroke embodiment above, the inserted position of the insertable percussion system 1 may correspond to a position where a majority of a playing surface of the upstroke drum (e.g., the skin of the percussion instrument 3) faces or vertically overlaps a majority of a playing surface of the downstroke drum 103. The retracted position of the insertable percussion system 1, on the other hand, may correspond to a position where the majority of the playing surface of the upstroke drum (e.g., the skin of the percussion instrument 3) does not face or does not vertically overlap the majority of the playing surface of the downstroke drum 103.

In the illustrated embodiment, the inserting/retracting mechanism 7 includes a first arm 13 and a second arm 15.

Figure 3:
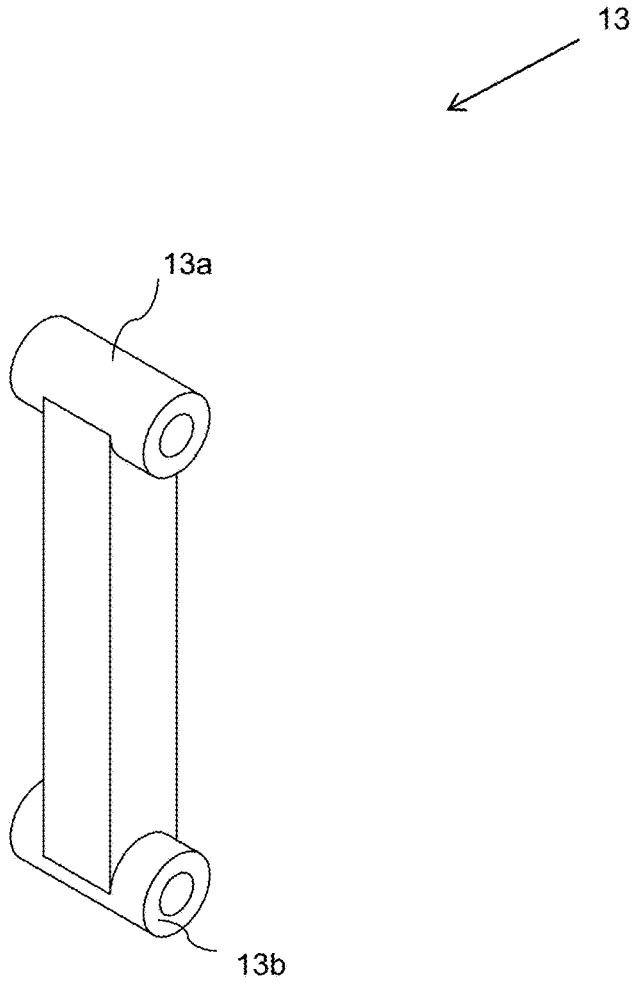
FIG. 3 illustrates a perspective view of an exemplary first arm of the insertable percussion system of FIG. 1.

FIG. 3 illustrates a perspective view of an exemplary first arm 13. The first arm 13 includes a percussion instrument end 13*a* that operably and rotably connects to the percussion instrument 3 as shown in FIGS. 1 and 2. The first arm 13 also includes a joint end 13*b* that is distal the percussion instrument 3. The joint end 13*b* operably and rotably connects to the second arm 15.

Figure 4:
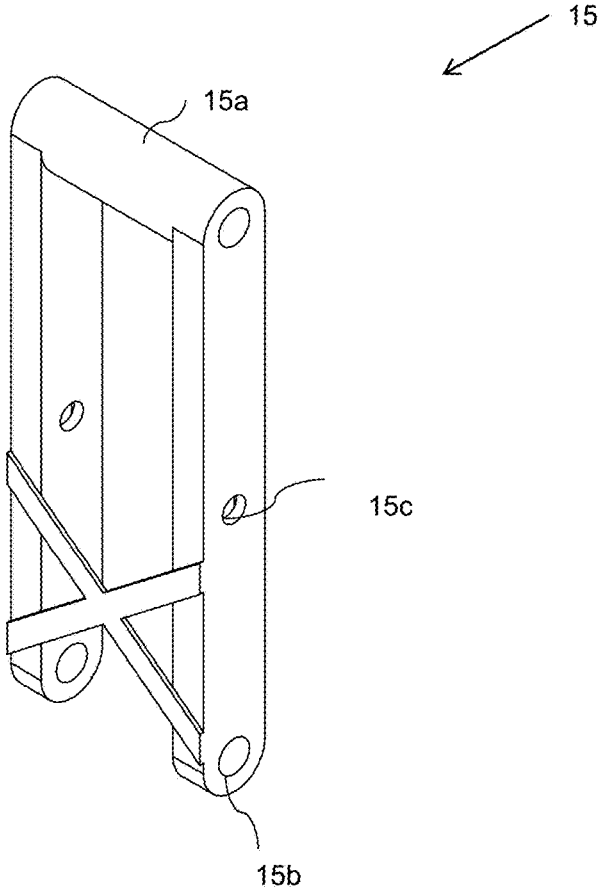
FIG. 4 illustrates a perspective view of an exemplary second arm of the insertable percussion system of FIG. 1.

FIG. 4 illustrates a perspective view of an exemplary second arm 15. The second arm 15 includes a stand end 15*a* that operably and rotably connects to the stand 5. The second arm 15 also includes a joint end 15*b* that is distal to the stand 5 and that operably and rotably connects to the joint end 13*b* of the first arm 13. The second arm 15 may also include a pull position 15*c* at which the second arm 15 may be operably connected to the cable 11.

Pulling of the cable 11 by operation of the pedal 9 causes the second arm 15 to rotate about the stand end 15*a* and the joint end 15*b*, and the first arm 13 to rotate about the joint end 13*b* and the percussion instrument end 13*a* to effectively stretch the inserting/retracting mechanism 7 causing the percussion instrument 3 to move horizontally away from the stand 5 to the inserted position.

Releasing of the cable 11 by operation of the pedal 9 causes the second arm 15 to, in opposite direction as in the inserting, rotate about the stand end 15*a* and the joint end 15*b*, and the first arm 13 to rotate about the joint end 13*b* and the percussion instrument end 13*a* to effectively contract the inserting/retracting mechanism 7 causing the percussion instrument 3 to move horizontally towards the stand 5 to the retracted position.

In the illustrated embodiment of FIGS. 1 and 2, the insertable percussion system 1 includes two first arms 13 each having a percussion instrument end 13*a* proximate the percussion instrument 3 and a joint end 13*b* distal the percussion instrument 3. In this embodiment, the insertable percussion system 1 also includes two second arms 15, each having a stand end 15*a* proximate the stand 5 and a joint end 15*b* distal the stand 5. In this embodiment, each of the joint ends 13*b* of the first arms is rotably connected to a respective one of the joint ends 15*b* of the second arm, and each of the first arms 13 is rotable about its percussion instrument end 13*a* and about its joint end 13*b*, and each of the second arms 15 is rotable about its stand end 15*a* and about its joint end 15*b* to stretch or contract the inserting/retracting mechanism 7 into the inserted position or the retracted position.

In one embodiment (not shown), the inserting/retracting mechanism 7 includes a spring configured in the inserting/retracting mechanism 7 to bias the inserting/retracting mechanism 7 towards retraction (i.e., in the retracted position). In this embodiment, pulling of the cable 11 by operation of the pedal 9 defeats tension force in the spring extending the spring and causing the second arm 15 to rotate about the stand end 15*a* and the joint end 15*b*, and the first arm 13 to rotate about the joint end 13*b* and the percussion instrument end 13*a* to effectively stretch the inserting/retracting mechanism 7 causing the percussion instrument 3 to move horizontally away from the stand 5 to the inserted position. Releasing of the cable 11 by operation of the pedal 9 allows tension force in the extended spring to retract the inserting/retracting mechanism 7 into the retracted position such that the percussion instrument 3 is moved horizontally towards the stand 5.

Figure 5:
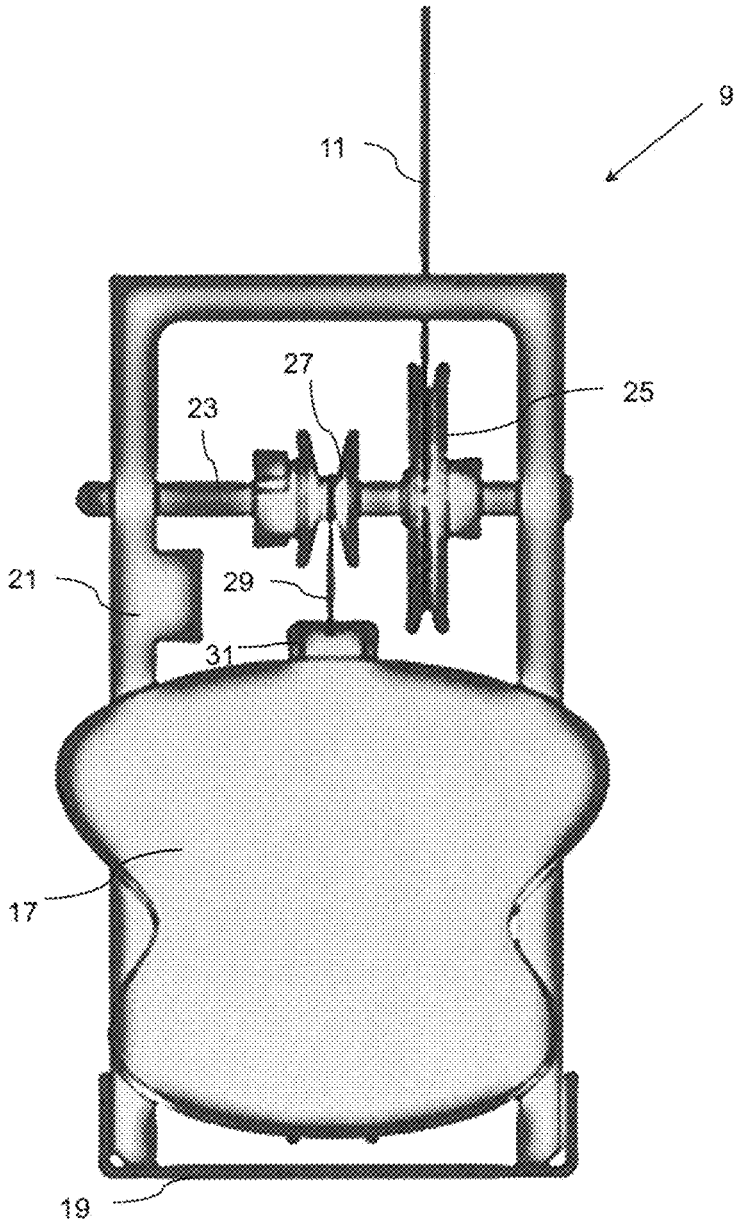
FIG. 5 illustrates a front view of an exemplary pedal for the insertable percussion system of FIG. 1.
Figure 6:
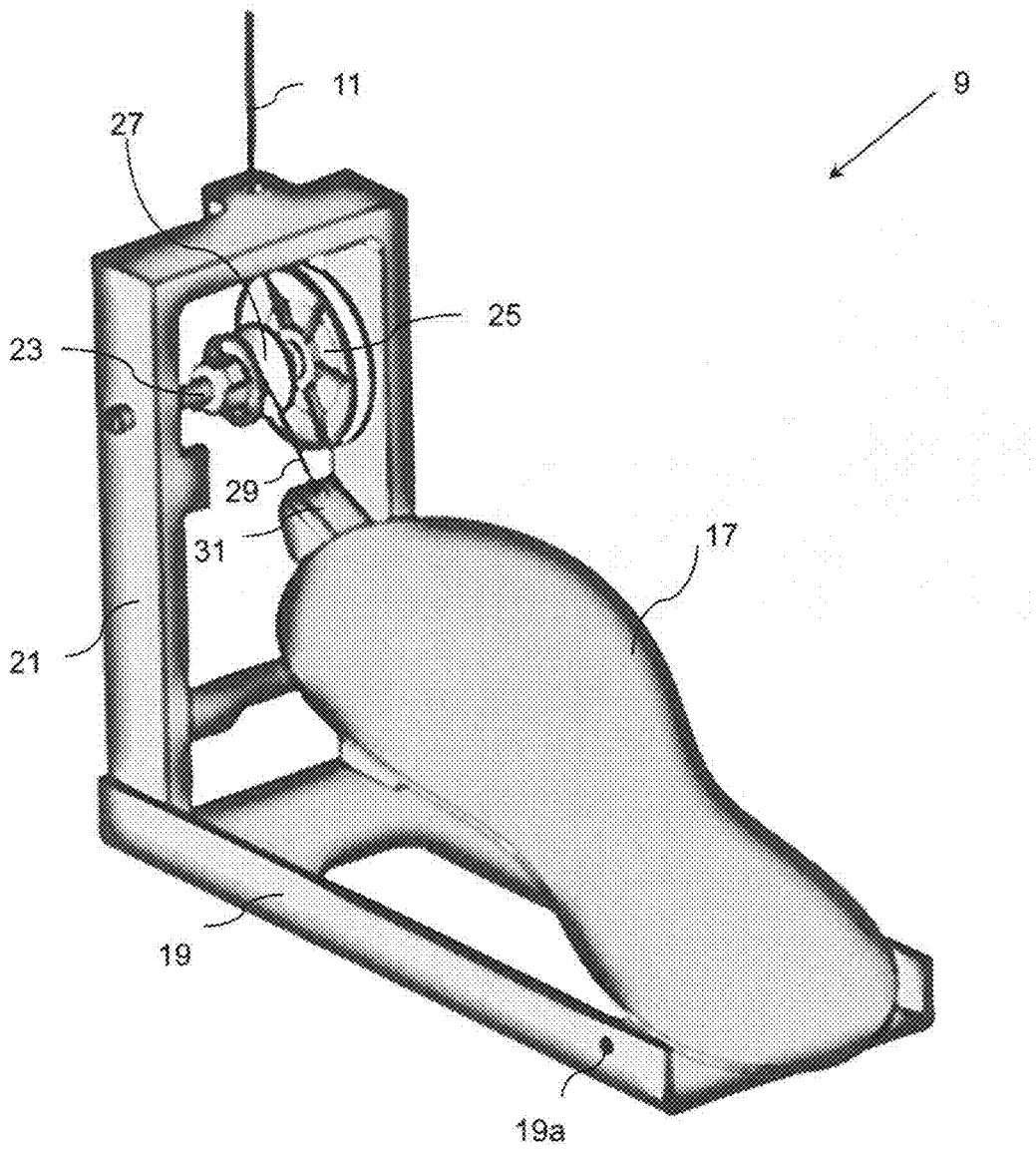
FIG. 6 illustrates a perspective view of the exemplary pedal for the insertable percussion system of FIG. 1.
Figure 7:
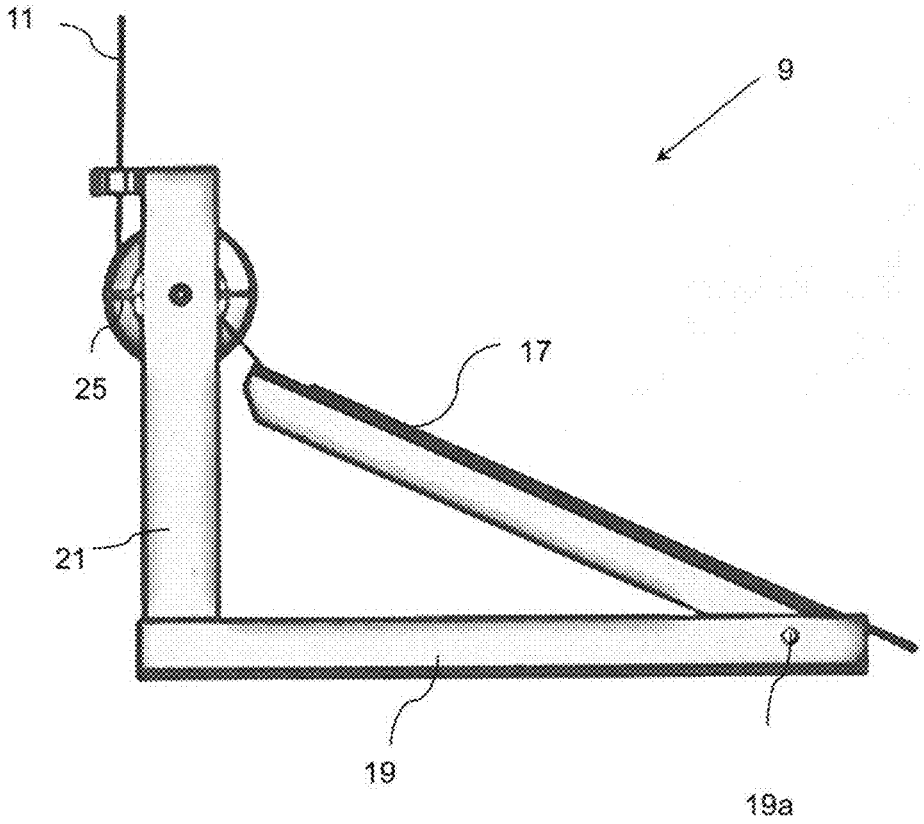
FIG. 7 illustrates a side view of the exemplary pedal for the insertable percussion system of FIG. 1.

FIGS. 5-7 illustrate front, perspective and side views, respectively, of an exemplary pedal 9 for the insertable percussion system 1. The pedal 9 may include a foot platform 17 rotably connected to a base 19 at a rotating location 19*a*. The foot platform 17 receives a foot or shoe of the person playing the insertable percussion system 1. The pedal 9 may also include a rising portion 21 that may have installed therein a rod 23 and cable wheels 25 and 27 that rotate about the rod 23. The cable wheel 27 is connected to the foot platform 17 by a cable 29. The cable wheel 25 connects to the cable 11 which, as described above, connects to the inserting/retracting mechanism 7.

Pressing of the foot or shoe of the person playing the insertable percussion system 1 causes the foot platform 17 to rotate about the rotating location 19*a*. This rotation pulls on the cable 29 which causes the rod 23 and the cable wheel 25 to also rotate effectively pulling on the cable 11 and stretching the inserting/retracting mechanism 7 into the inserted position.

Releasing of the foot or shoe of the person playing the insertable percussion system 1 causes the foot platform 17 to rotate, in the opposite direction as insertion, about the rotating location 19*a*. This opposite rotation releases the cable 29 which causes the rod 23 and the cable wheel 25 to also rotate effectively releasing on the cable 11 and retracting the inserting/retracting mechanism 7 into the retracted position.

Figure 8:
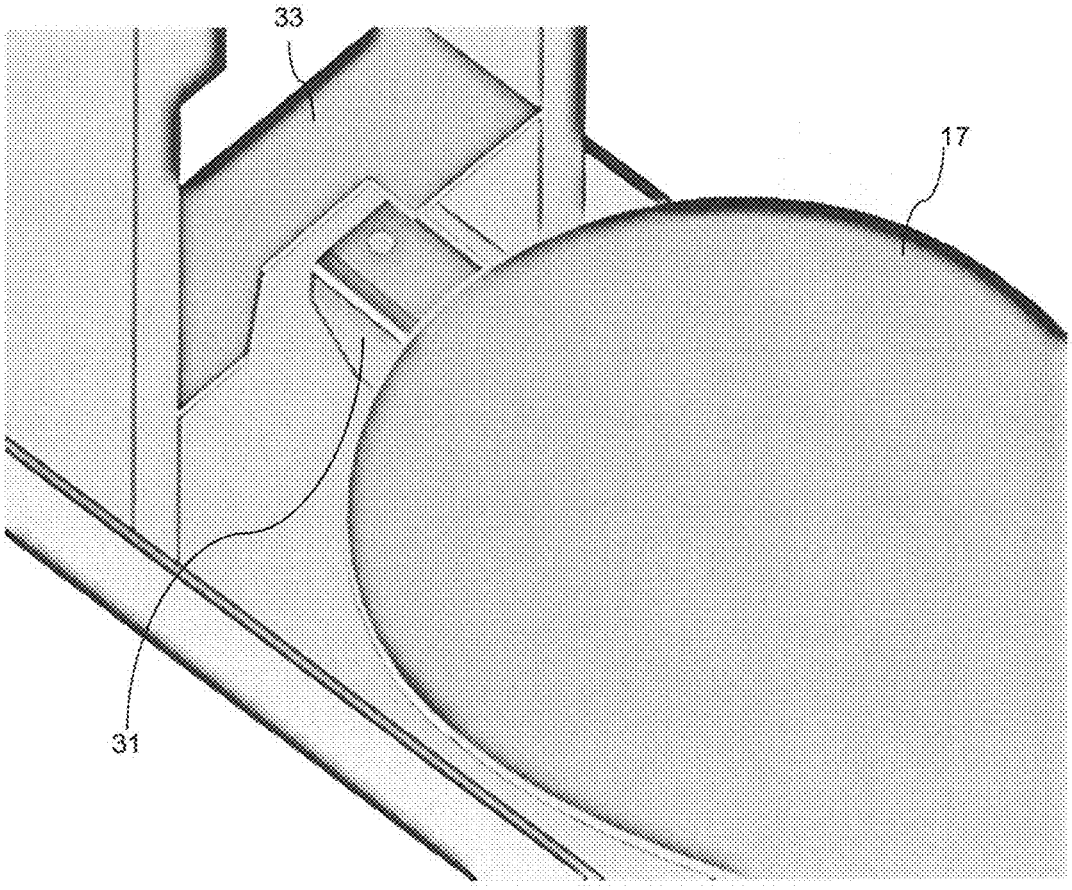
FIG. 8 illustrates a magnified view of the exemplary pedal for the insertable percussion system of FIG. 1 illustrating a latching mechanism.

FIG. 8 illustrates a magnified view of the exemplary pedal 9. Specifically, FIG. 8 illustrates a locking or latching mechanism of the foot platform 17 while pressed. While pressed, the player or percussionist may move the foot platform 17 laterally or sideways to engage a latching tab 31 connected to the foot platform 17 to a latching bracket 33 connected to the rising portion 21. This effectively latches the inserting/retracting mechanism 7 in the inserted position.

When the player or percussionist desires to retract the percussion instrument 3 to the retracted position, the player or percussionist may move the foot platform 17 laterally or sideways in the opposite direction as engagement to disengage the latching tab 31 from the latching bracket 33. The player or percussionist may then release his foot or shoe from the foot platform 17 to retract the inserting/retracting mechanism 7 into the retracted position.

Figure 9:
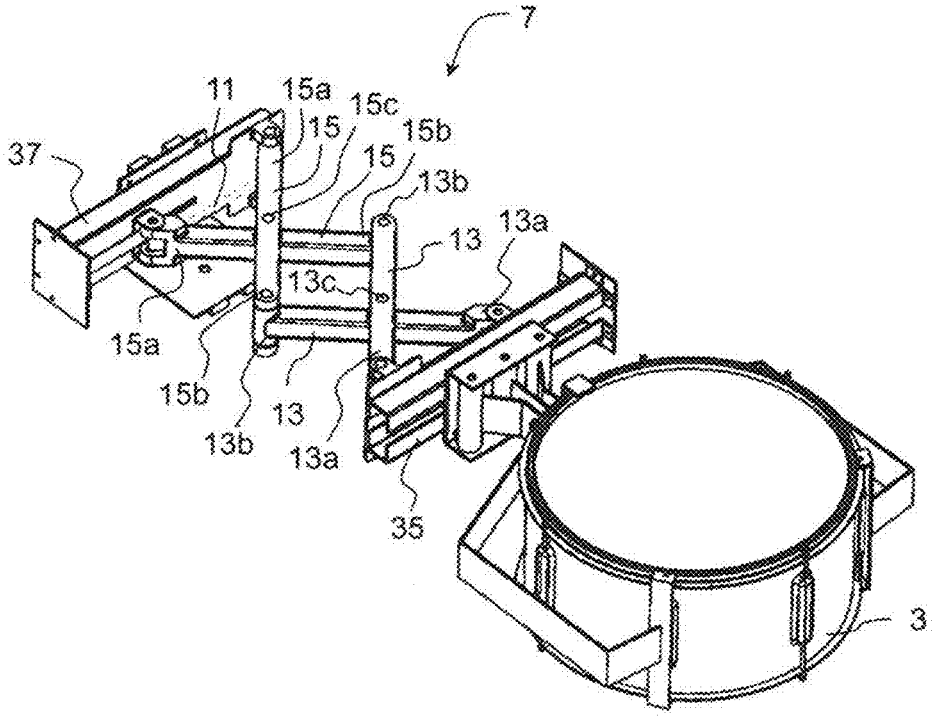
FIG. 9 illustrates a perspective view of an exemplary insertion/extraction mechanism.
Figure 10:
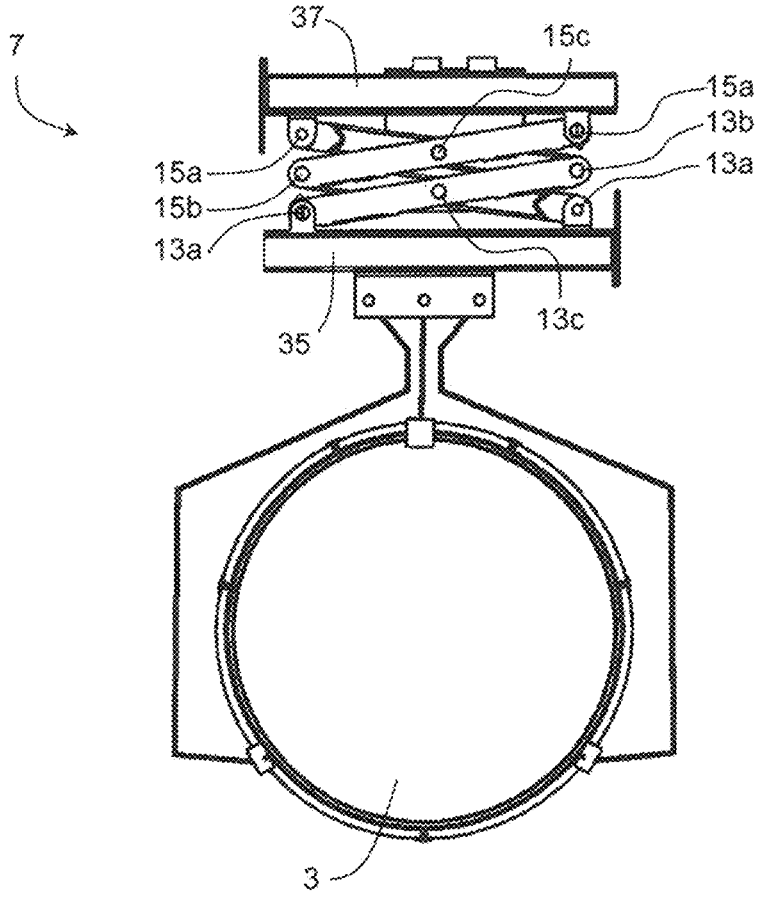
FIG. 10 illustrates a top view of the exemplary insertion/extraction mechanism of FIG. 9 in the extracted position.
Figure 11:
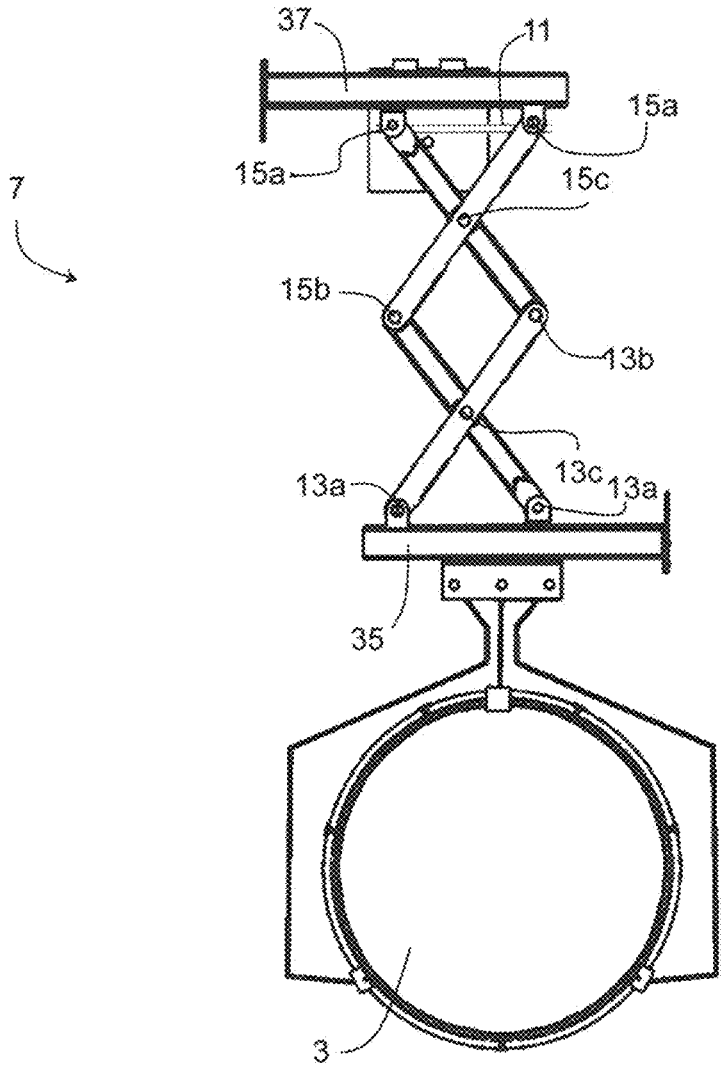
FIG. 11 illustrates a top view of the exemplary insertion/extraction mechanism of FIG. 9 in the inserted position.

FIGS. 9-11 illustrate a second embodiment of the inserting/retracting mechanism 7 for the insertable percussion system 1. In the embodiment of FIG. 9, the inserting/retracting mechanism 7 includes the first arm 13 and a second arm 15, which are similar to the first arm 13 and the second arm 15 of the first embodiment except that, in this second embodiment, the first arm 13 and the second arm 15 crisscross resulting in insertion and retraction of the inserting/retracting mechanism 7 to have a scissoring effect.

The first arm 13 includes a percussion instrument end 13*a* that operably and rotably connects to the percussion instrument 3. In the illustrated embodiment, the exemplary insertable percussion system 1 includes a slide bracket 35 that operably and rotably connects the percussion instrument end 13*a* to the percussion instrument 3. The first arm 13 also includes a joint end 13*b* that is distal the percussion instrument 3. The joint end 13*b* operably and rotably connects to the second arm 15.

The second arm 15 includes a stand end 15*a* that operably and rotably connects to the stand 5. In the illustrated embodiment, the exemplary insertable percussion system 1 includes a slide bracket 37 that operably and rotably connects the stand end 15*a* to the stand 5. The stand end 15*a* of the second arm 15 may be connected to the cable 11. The second arm 15 also includes a joint end 15*b* that is distal to the stand 5 and that operably and rotably connects to the joint end 13*b* of the first arm 13.

In the illustrated embodiment of FIGS. 9-11, the insertable percussion system 1 includes two first arms 13 each having a percussion instrument end 13*a* proximate the percussion instrument 3, a joint end 13*b* distal the percussion instrument 3, and a joint position 13*c*. In this embodiment, the insertable percussion system 1 also includes two second arms 15, each having a stand end 15*a* proximate the stand 5, a joint end 15*b* distal the stand 5, and a joint position 15*c*. In this embodiment, each of the joint ends 13*b* of the first arms 13 is rotably connected to a respective one of the joint ends 15*b* of the second arm, each of the joint positions 13*c* of the first arm 13 is operably and rotably connected to the joint position 13*c* of the other first arm 13, and each of the joint positions 15*c* of the second arm 15 is operably and rotably connected to the joint position 15*c* of the other first arm 15. Each of the first arms 13 is rotable about its percussion instrument end 13*a*, about its joint end 13*b*, and about its joint position 13*c*. Each of the second arms 15 is rotable about its stand end 15*a*, about its joint end 15*b*, and about its joint position 15*c* to stretch or contract the inserting/retracting mechanism 7 into the inserted position or the retracted position.

Pulling of the cable 11 by operation of the pedal 9 causes the second arm 15 to rotate about the stand end 15*a*, the joint end 15*b*, and the joint position 15*c*. This causes the first arm 13 to rotate about the joint end 13*b*, about the percussion instrument end 13*a*, and about the joint position 13*c* to effectively stretch the inserting/retracting mechanism 7 causing the percussion instrument 3 to move horizontally away from the stand 5 to the inserted position.

Releasing of the cable 11 by operation of the pedal 9 causes the second arm 15 to, in opposite direction as in the inserting, rotate about the stand end 15*a*, the joint end 15*b*, and the joint position 15*c*. This causes the first arm 13 to rotate about the joint end 13*b*, the percussion instrument end 13*a*, and the joint position 13*c* to effectively contract the inserting/retracting mechanism 7 causing the percussion instrument 3 to move horizontally towards the stand 5 to the retracted position.

In one embodiment (not shown), the inserting/retracting mechanism 7 includes a spring configured in the inserting/retracting mechanism 7 to bias the inserting/retracting mechanism 7 towards retraction (i.e., in the retracted position). In this embodiment, pulling of the cable 11 by operation of the pedal 9 defeats tension force in the spring extending the spring and causing the second arm 15 to rotate about the stand end 15*a*, the joint end 15*b*, and the joint position 15*c*. This causes the first arm 13 to rotate about the joint end 13*b*, the percussion instrument end 13*a*, and the joint position 13*c* to effectively stretch the inserting/retracting mechanism 7 causing the percussion instrument 3 to move horizontally away from the stand 5 to the inserted position. Releasing of the cable 11 by operation of the pedal 9 allows tension force in the extended spring to retract the inserting/retracting mechanism 7 into the retracted position such that the percussion instrument 3 is moved horizontally towards the stand 5.

The term "percussion instrument" as used herein refers to musical instruments in which sound is generally obtained by striking the instrument with hands, beaters, sticks, etc. and their electronic equivalents. Examples of percussion instruments include drums, cymbals, bells, cowbells, hi-hats, tambourines, wood blocks, kettle drums, steel drums, bongo drums, tom-toms, bass drums, tenor drums, snare drums, etc. The term "drum" as used herein corresponds to any type of percussion musical instrument having at least one stretched membrane to generate sound by acoustic vibration when the stretched membrane is struck or their electronic equivalent (e.g., electronic drum pad.)

While example systems, methods, and so on, have been illustrated by describing examples, and while the examples have been described in considerable detail, it is not the intention to restrict or in any way limit the scope of the appended claims to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, and illustrative examples shown or described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components. An "operable connection," or a connection by which entities are "operably connected," is one by which the operably connected entities or the operable connection perform its intended purpose. For example, two entities may be operably connected to each other directly or through one or more intermediate entities.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (3D. Ed. 1995).

What is claimed is:

1. A drumming system comprising:

a first percussion instrument; and an inserting/retracting mechanism operably connected to the first percussion instrument and configured to move the first percussion instrument along a horizontal axis relative to a second percussion instrument from a retracted position to an inserted position and from the inserted position to the retracted position;

wherein the inserted position corresponds to a position where a majority of a playing surface of the first percussion instrument faces or vertically overlaps a majority of a playing surface of the second percussion instrument.

2. The drumming system of claim 1 comprising:

a pedal operably connected to the inserting/retracting mechanism so that operation of the pedal moves the first percussion instrument horizontally relative to the second percussion instrument from the retracted position to the inserted position and from the inserted position to the retracted position; and a stand operably connected to the inserting/retracting mechanism and having a base and, the stand disposed relative to the pedal to vertically separate the first percussion instrument from the pedal.

3. The drumming system of claim 2 wherein the inserting/retracting mechanism includes:

a first arm having a percussion instrument end proximate the first percussion instrument and a joint end distal the first percussion instrument;

a second arm having a stand end proximate the stand and a joint end distal the stand;

wherein the joint end of the first arm is rotably connected to the joint end of the second arm, and the first arm is rotable about the first percussion instrument end and about the joint end and the second arm is rotable about the stand end and about the joint end to stretch the inserting/retracting mechanism into the inserted position such that the first percussion instrument is moved horizontally away from the stand.

4. The drumming system of claim 2 wherein the inserting/retracting mechanism includes:

two first arms each having a percussion instrument end proximate the first percussion instrument and a joint end distal the first percussion instrument; and two second arms each having a stand end proximate the stand and a joint end distal the stand, wherein each of the joint ends of the first arms is rotably connected to a respective one of the joint ends of the second arm, and each of the first arms is rotable about its percussion instrument end and about its joint end and each of the second arms is rotable about its stand end and about its joint end to stretch the inserting/retracting mechanism into the inserted position such that the first percussion instrument is moved horizontally away from the stand.

5. The drumming system of claim 2 comprising:

a cable connecting the pedal to the inserting/retracting mechanism, wherein the inserting/retracting mechanism includes:

a first arm having a percussion instrument end proximate the first percussion instrument and a joint end distal the first percussion instrument; and a second arm having a stand end proximate the stand and a joint end distal the stand;

wherein the joint end of the first arm is rotably connected to the joint end of the second arm, and the first arm is rotable about the percussion instrument end and about the joint end and the second arm is rotable about the stand end and about the joint end such that pulling of the cable by the pedal stretches the inserting/retracting mechanism into the inserted position such that the first percussion instrument is moved horizontally away from the stand and such that loosening of the cable by the pedal allows the inserting/retracting mechanism to retract into the retracted position such that the first percussion instrument is moved horizontally towards the stand.

6. The drumming system of claim 2 wherein the pedal includes a latching mechanism for latching the inserting/retracting mechanism in the inserted position.

7. The drumming system of claim 1 wherein the first percussion instrument corresponds to an upstroke drum and the second percussion instrument corresponds to a downstroke drum and wherein the inserted position corresponds to a position where a majority of a playing surface of the upstroke drum faces or vertically overlaps a majority of a playing surface of the downstroke drum.

8. The drumming system of claim 1 wherein the first percussion instrument corresponds to an upstroke drum and the second percussion instrument corresponds to a downstroke drum and wherein the retracted position of the upstroke drum corresponds to a position where a majority of a playing surface of the upstroke drum does not face or does not vertically overlap a majority of a playing surface of the downstroke drum.

9. A method of drumming comprising:

pressing a pedal that causes an insertion mechanism to move a percussion instrument from a retracted position along a horizontal axis to be inserted into an inserted position, wherein the percussion instrument corresponds to an upstroke instrument to be hit by a beater or drum stick with an upstroke or upward motion and a second percussion instrument corresponds to a downstroke instrument to be hit by the beater or drum stick with a downstroke or downward motion, wherein the inserted position corresponds to a position where a playing surface of the upstroke instrument faces or vertically overlaps a playing surface of the downstroke instrument, and wherein the retracted position corresponds to a position where a majority of a playing surface of the upstroke instrument does not face or does not vertically overlap a playing surface of the downstroke instrument.

10. The method of claim 9 wherein the percussion instrument corresponds to an upstroke drum and the second percussion instrument corresponds to the downstroke drum and wherein the pressing the pedal causes the upstroke drum to be inserted into the inserted position where a majority of a playing surface of the upstroke drum faces or vertically overlaps a majority of a playing surface of the downstroke drum.

11. The method of claim 10 comprising at least one:

hitting the downstroke drum with a drum stick or beater on a downstroke motion, and hitting the upstroke drum with the drum stick or beater on an upstroke motion immediately proceeding the downstroke motion, or hitting the upstroke drum with a drum stick or beater on an upstroke motion, and hitting the downstroke drum with the drum stick or beater on a downstroke motion immediately proceeding the upstroke motion.

12. The method of claim 9 comprising:

locking the pedal while pressed to retain the percussion instrument in the inserted position, and unlocking the pedal and releasing the pedal to retract the percussion instrument horizontally into a retracted position.

13. The method of claim 12 wherein the percussion instrument corresponds to an upstroke drum and the second percussion instrument corresponds to the downstroke drum, the pressing the pedal causes the upstroke drum to be inserted into the inserted position where a majority of a playing surface of the upstroke drum faces or vertically overlaps a majority of a playing surface of the downstroke drum, the locking the pedal causes the upstroke drum to be retained in the inserted position, and the unlocking the pedal and releasing the pedal retracts the upstroke instrument horizontally such that the majority of the playing surface of the upstroke drum does not face or does not vertically overlap the majority of the playing surface of the downstroke drum.

14. A percussion system comprising:

a pedal; and an inserting/retracting mechanism operably connected to a percussion instrument and the pedal, the inserting/retracting mechanism configured to move the percussion instrument along a horizontal axis from a first position to a second position and from the second position to the first position by operation of the pedal; and a stand operably connected to the inserting/retracting mechanism and having a base, wherein the first position corresponds to a position where the inserting/retracting mechanism is extended such that the percussion instrument moves horizontally away from the stand, and the second position corresponds to a position where the inserting/retracting mechanism is collapsed such that the percussion instrument moves horizontally towards the stand.

15. The percussion system of claim 14, wherein, the stand is disposed relative to the pedal to vertically separate the percussion instrument from the pedal.

16. The percussion system of claim 15 wherein the inserting/retracting mechanism includes:

a first arm having an instrument end proximate the percussion instrument and a joint end distal the percussion instrument; and a second arm having a stand end proximate the stand and a joint end distal the stand, wherein the joint end of the first arm is rotably connected to the joint end of the second arm, and the first arm is rotable about the percussion instrument end and about the joint end and the second arm is rotable about the stand end and about the joint end to stretch the inserting/retracting mechanism such that the percussion instrument is moved horizontally away from the stand.

17. The percussion system of claim 15 wherein the inserting/retracting mechanism includes:

two first arms each having an instrument end proximate the percussion instrument and a joint end distal the percussion instrument; and two second arms each having a stand end proximate the stand and a joint end distal the stand, wherein each of the joint ends of the first arms is rotably connected to a respective one of the joint ends of the second arm, and each of the first arms is rotable about its instrument end and about its joint end and each of the second arms is rotable about its stand end and about its joint end to stretch the inserting/retracting mechanism such that the percussion instrument is moved horizontally away from the stand.

18. The percussion system of claim 15 comprising:

a cable connecting the pedal to the inserting/retracting mechanism, wherein the inserting/retracting mechanism includes:

a first arm having an instrument end proximate the percussion instrument and a joint end distal the percussion instrument; and a second arm having a stand end proximate the stand and a joint end distal the stand; and wherein the joint end of the first arm is rotably connected to the joint end of the second arm, and the first arm is rotable about the instrument end and about the joint end and the second arm is rotable about the stand end and about the joint end such that pulling of the cable by the pedal stretches the inserting/retracting mechanism such that the percussion instrument is moved horizontally away from the stand and such that loosening of the cable by the pedal allows the inserting/retracting mechanism to retract such that the percussion instrument is moved horizontally towards the stand.

19. The percussion system of claim 14 wherein the pedal includes a latching mechanism for latching the inserting/retracting mechanism in the first position or in the second position.

* * * * *